US005987839A

United States Patent [19]

Hamar et al.

[11] Patent Number: 5,987,839

[45] Date of Patent: Nov. 23, 1999

[54] MULTI-PANEL ACTIVITY FLOOR WITH FIXED HINGE CONNECTIONS

[76] Inventors: Douglas J Hamar, 220 Willson Memorial Dr.; Mark S Young, P.O. Box 318, both of Chassel, Mich. 49916; Richard E Granroth, 197 Red Jacket Rd., Laurium, Mich. 49913

[21] Appl. No.: 09/081,895

[22] Filed: May 20, 1998

Related U.S. Application Data

[60] Provisional application No. 60/047,204, May 20, 1997.

[51] Int. Cl.[6] ..... G04B 1/19

[52] U.S. Cl. ..... 52/582.1; 52/586.1; 52/592.1; 52/480; 52/126.1; 52/65; 403/52; 403/65; 403/66; 403/68

[58] Field of Search ..... 52/582.1, 586.1, 52/592.1, 65, 126.1, 126.5, 480; 403/52, 65, 66, 68, 71, 393, 292, 294, 13

[56] References Cited

U.S. PATENT DOCUMENTS

| | | | |
|---|---|---|---|
| 841,998 | 1/1907 | Mulford | 403/71 |
| 3,566,569 | 3/1971 | Coke et al. . | |
| 3,802,144 | 4/1974 | Spica | 52/591 |
| 3,874,132 | 4/1975 | Mendelow et al. | 52/71 |
| 3,946,529 | 3/1976 | Chevanaux . | |
| 3,967,428 | 7/1976 | Pierce et al. . | |
| 4,008,548 | 2/1977 | Leclerc | 52/180 |
| 4,527,362 | 7/1985 | Tobey et al. | 52/71 |
| 4,538,392 | 9/1985 | Hamar et al. | 52/582 |
| 4,831,806 | 5/1989 | Niese et al. . | |
| 4,846,762 | 7/1989 | Betterton et al. | 464/87 |
| 4,860,510 | 8/1989 | Kotler | 52/177 |
| 4,890,434 | 1/1990 | Niese . | |
| 4,995,210 | 2/1991 | Niese et al. . | |
| 5,465,546 | 11/1995 | Buse | 52/480 |
| 5,570,971 | 11/1996 | Rixen et al. | 403/381 |

*Primary Examiner*—Carl D. Friedman
*Assistant Examiner*—Phi Dieu Tran A

[57] ABSTRACT

A portable activity floor comprised of a plurality of separate panels that can be readily and selectively interlocked together into a finalized configuration. Each panel has an underlayment providing a core with spaced stringers fastened to the underside thereof. Elongated finishing strips mounted on the upper surface of the underlayment form the outer surface of the panel. In one type of floor assembly, alternate strips are longer than their adjacent strips at the inner side of each panel to form laterally spaced interlock fingers. A pair of hinge members pivotally connects adjacent panels to one another and allows them to be relatively pivoted on a fixed axis with finger interlock alignment accuracy from an initial connected position to a fully assembled position in which the fingers of the finishing strips closely mesh and interlock. Further, the hinge members when connected prevent lateral movement of adjacent panels. This allows the hinge assembly to be used with many types of floors, such as in addition to floors with interlock fingers, square edge floors, square end floors and parquet floors.

13 Claims, 5 Drawing Sheets

MULTI-PANEL ACTIVITY FLOOR WITH FIXED HINGE CONNECTIONS

This appln claims the benefit of U.S. Provisional Appln. No. 60/047,204 filed May 20, 1997.

FIELD OF THE INVENTION

This invention relates to portable floors particularly well adapted for sports and other activities, and more particularly, to a new and improved multi-panel portable activity floor featuring advanced hinge designs that provide a fixed pivot and turning axis between adjacent panels for an improved interconnection between panels.

BACKGROUND OF THE DISCLOSURE

Prior to the present invention, portable flooring systems have been utilized to expand the capability of arenas, gymnasiums, and other facilities to accommodate a wide range of sports, dance and other activities. Commonly assigned U.S. Pat. No. 4,538,392, issued Sep. 3, 1985, hereby incorporated by reference, is an example of such flooring systems and is drawn to a high quality multi-panel portable floor utilizing a plurality of portable panels which can be readily stored, handled and assembled by workmen with average mechanical skill.

Generally, assembly of such panels into a completed floor requires careful initial preassembly connection of one panel to the next and subsequent careful movement of the panels into a final aligned and locked in place position. This is especially the case with high quality wooden floors having interdigitated locking fingers forming finger joints at the intersection of adjacent panels.

As a general practice, such fingers, particularly those near the latch device connecting adjacent panels have to be closely observed and manually guided with care into place. This initial fitting of the innermost interlock fingers establishes the pivot point in the latch device and between panels and assures good alignment and mechanical interfit of all of the joint fingers. Such prior construction and practice importantly reduces or prevents undue damage to individual fingers as they progressively interlock with one another. Similar attention and care must be taken with such floors on disassembly to eliminate damage to the finger joints.

While such prior constructions and practices have provided for improved floors that have exceeded expectations and standards, some wear occurs at the innermost finger joints since they are material factors in establishing panel alignment and the pivot point between two panels being relatively turned into their assembled and locked position.

SUMMARY OF THE INVENTION AND ADVANTAGES

According to the present invention, there is provided a portable multi-panel floor capable of being assembled from a plurality of rectilinear floor panels into a unitized structure. The panels have end edges adapted to abut one another in edge-to-edge alignment. The panels further include a pivot bracket set releasably and pivotally connecting adjacent floor panels to one another. Each of the bracket sets comprises a first bracket member secured to said first panel having a pivot disposed at one corner of said first panel and a second bracket member secured to said second panel and having an opening for receiving said pivot disposed at one corner of said second panel. The pivot operatively fits into the opening for pivotally connecting said first and second panels to one another so that said panels can be initially interconnected to one another and rotated on a fixed pivot axis formed by said pivot and said opening from an initial position to an assembled position in which said panels abut one another in edge-to-edge alignment and cooperate to form a continuous performance floor.

To improve the interconnection of such panels to one another, the present invention is drawn to new and improved panel connector bracketry having special panel support and fixed pivot construction without reliance on any finger joints for such purposes. This invention is further drawn to new and improved methods to positively interconnect adjacent floor panels to one another.

In this invention, separate male and female pivot connector brackets are employed for selected panels of the activity floor which provides for a fixed positive pivot axis that allows the panels to be initially connected in a precise preassembly position on such axis. With the panels pivotally connected on the fixed pivot axis, installation efforts are minimized.

With this invention, after the initial pivot connection of two panels on the fixed pivot, the panels can be relatively rotated in a plane parallel to the support floor into assembly position with relative ease and with assurance of optimized finger joint interdigitation. More particularly, with this invention undue wear or other damage to any of the fingers of the joints is minimized.

With the improved construction provided by this invention, disassembly of the floor into its base panel components is also simplified and accomplished with minimized effort. Further, lateral alignment between the panel components is achieved with greater precision.

In this invention, discrete floor panels can be readily assembled together from a starting panel using this invention to form a first and starting row. Subsequent panels are affixed to the lower side of the panels of the starting row and to one another to sequentially form additional rows utilizing the improved bracket and pivot construction to ultimately define the flooring area.

The floor panels may be constructed to any predetermined dimensions, such as, for example, 4'×8' and 4'×4', and installed in a predetermined pattern. The side joints between adjoining panels may be in staggered relationships so that there are no straight seams. This invention further allows for further staggering of the interface between any two adjacent panels with an improved interdigitated connection between adjacent strips or boards of the floor surface to provide a tighter and smoother performance surface with reliable stability and attractive appearance.

A feature, object and advantage of this invention is to provide a new and improved multi-panel activity floor which has an improved pivot joint which positively establishes a pivot axis between adjacent panels and allows the panels to be readily connected together in an initial position. From such position, the panels can be relatively turned or rotated on the fixed axis to a finalized assembly position. Thus, the assembly provides for lateral alignment of the respective adjacent panels.

It is another feature, object and advantage of this invention to provide a new and improved method of interlocking panels of portable flooring to one another in which an initial common and fixed pivot point is precisely established at or near the corners of any two adjacent panels being joined that allows the panels to be relatively rotated from an initial connected position into a finalized and assembled position with precise interdigitation of staggered fingers along the seam to provide an interlock with minimized wear to the interface thereof.

Another feature, object and advantage of this invention is to provide new and improved pivot brackets for interconnecting discrete panels for an activity floor that incorporates a vertical stop integrated with pivot pin construction to improve the lateral alignment of the panels with one another. More specifically, when the brackets are connected and the two surfaces contact one another, the respective adjacent panels are more precisely aligned such that the floor surfaces are flush.

Another feature object and advantage of the present invention is that the pivot brackets, when assembled, prevent lateral movement of the adjacent panels. This advantage is particularly beneficial when the brackets are used in connection with square edge, square end or parquet type floors that do not have interdigitated fingers.

These and other objects, features and advantages will become more apparent from the following detailed description when considered in connection with the accompanying drawings in which:

DETAILED DESCRIPTION OF THE PREFERRED EMBODIMENT

Figure 1:
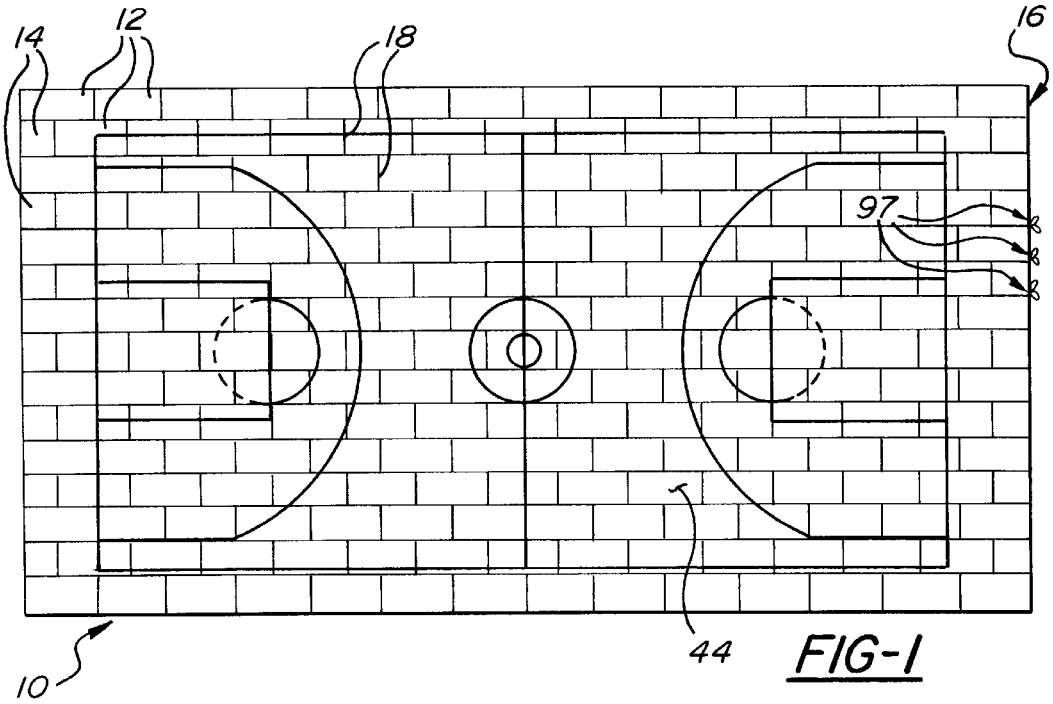
FIG. 1 is a top plan view of an activity floor with court markings for basketball assembled from a plurality of portable rectilinear panels.

Turning now in greater detail to the drawings, there is shown in FIG. 1 a portable, multiple panel activity floor 10 whose playing surface may be lined and otherwise marked to define a court for basketball, or other desired activity. The floor 10 is assembled from a plurality of discrete floor panels 12 and 14 which are selectively connected to one another into a plurality of longitudinally extending rows 16 that are securely interconnected with one another to form the complete floor with staggered joints 18.

Floor panels 12 in the preferred embodiment of the invention are preferably four by eight feet respectively in width and length and floor panels 14 are preferably four by four feet in width and length. While the panels of the floor have different overall dimensions, their general construction is otherwise the same. Similarly, it is to be understood that any size floor panels can be used within the scope of the present invention.

Thus, it is to be understood that panels 12 and 14 are preferably identical in construction. The panels denoted 14 are those having a shorter overall length than the panels 12. The shorter panels 14 allow for staggering of the ends of the panels 12, 14 such that there are no straight seams 18 of panels across the width of the floor.

Figure 3:
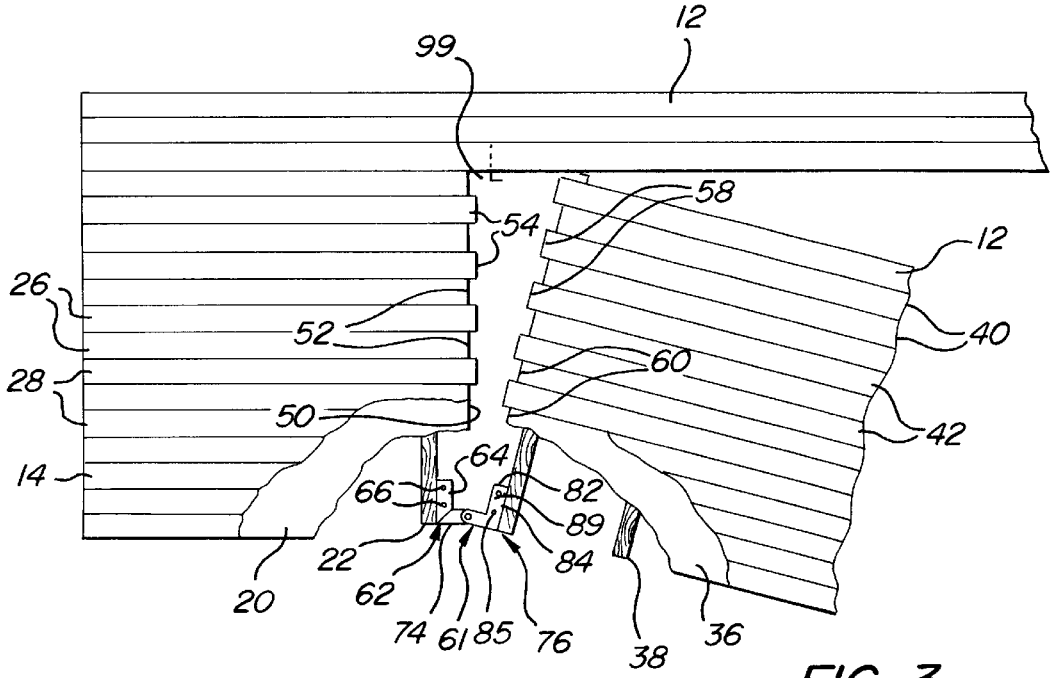
FIG. 3 is an enlarged view of a portion of FIG. 2 with parts broken away illustrating the fixed pivot connection between adjacent floor panels.
Figure 4:
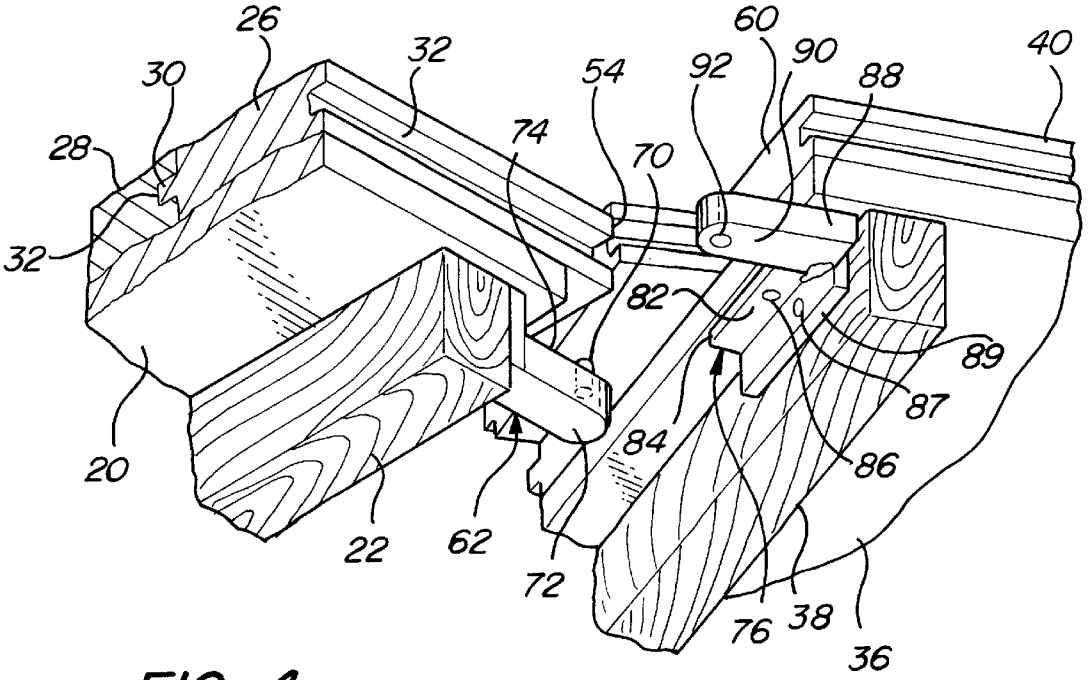
FIG. 4 is pictorial view of portions of floor panels being pivotally connected together prior to assembly with one another.
Figure 6:
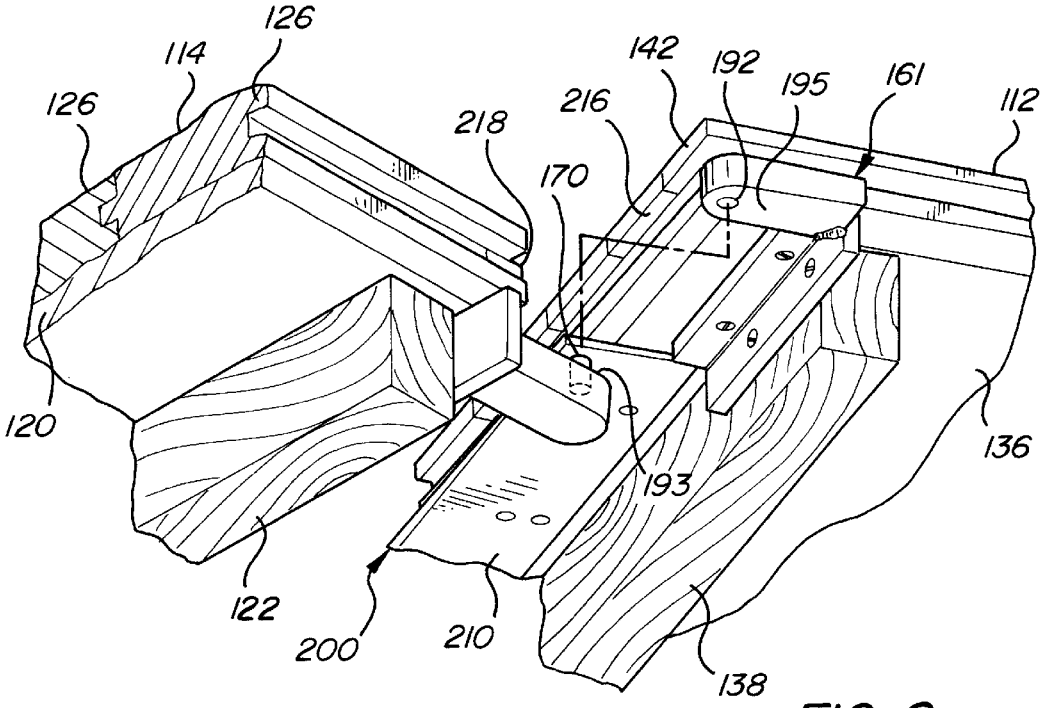
FIG. 6 is a pictorial view of portions of floor panels of an alternative embodiment being pivotally connected together prior to assembly with one another.
Figure 5:
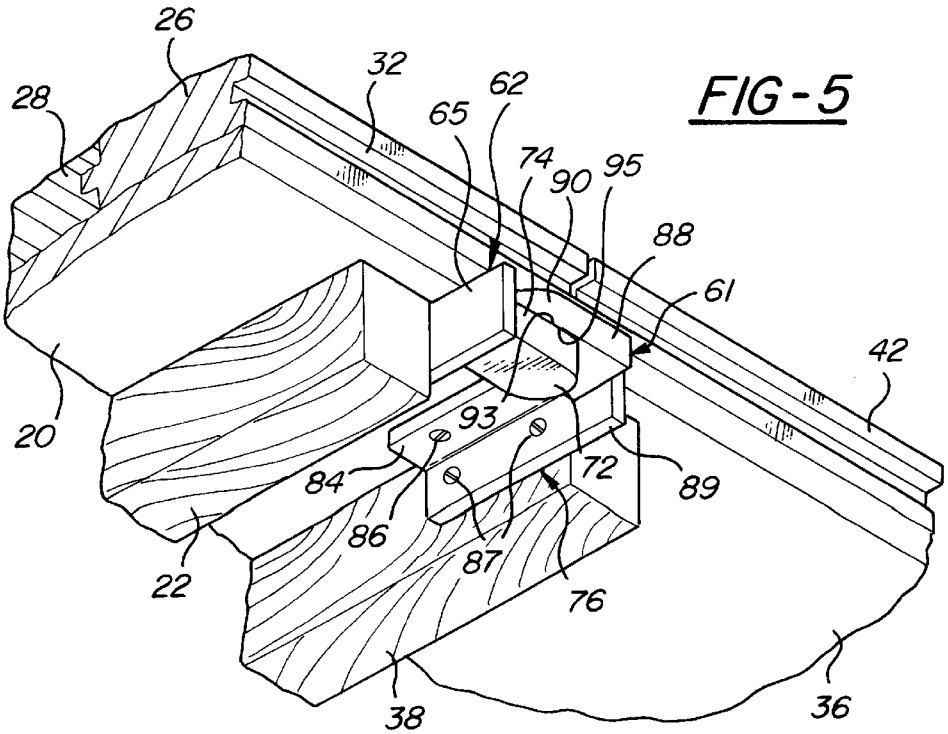
FIG. 5 is a pictorial view similar to that of FIG. 4 showing the floor panels pivotally moved into an assembly position.
Figure 7:
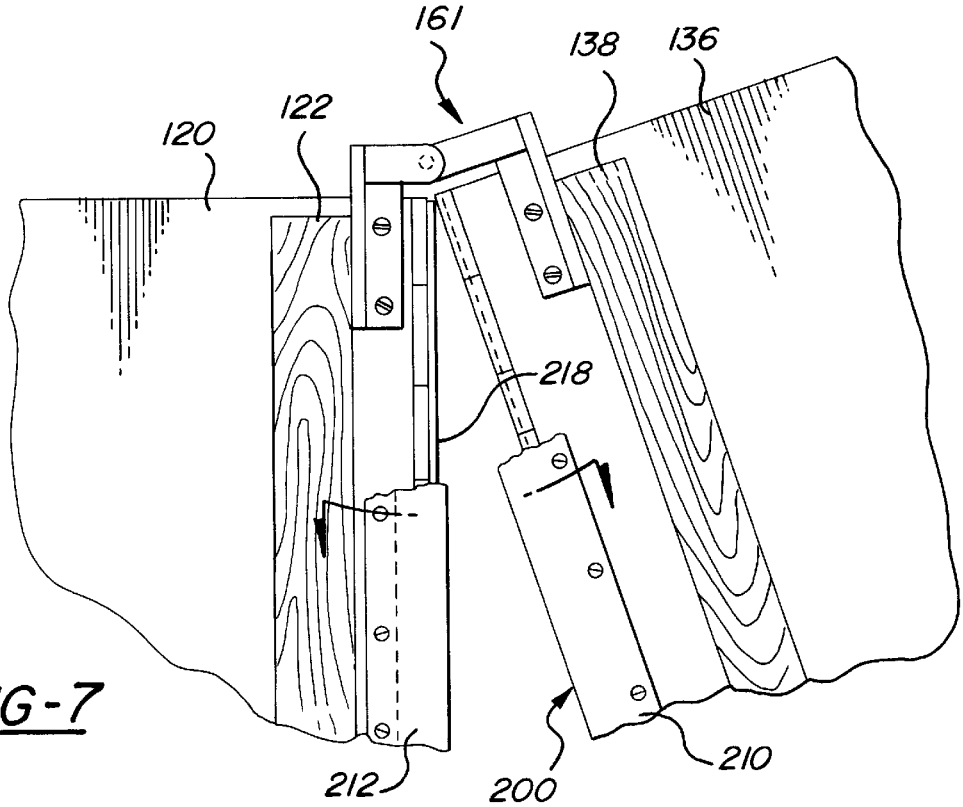
FIG. 7 is a bottom view of the floor of FIG. 6 with parts broken away.

As best shown in FIGS. 3–5, each panel 14 is constructed from a rectangular or square flat core or underlayment 20 of oriented strand board, plywood or ther sheet of suitable structural material nailed or therwise secured to a plurality of parallel support stringers 22. These stringers 22 are preferably rectangular or square in cross-section and are equally spaced from one another and extend under and across the width of the underlayment. The stringers 22 serve as the feet or contacts with the support floor or surface 24. In the preferred embodiment, a plurality of flat flooring strips 26, 28 of northern maple or other suitable hardwood are fastened to the upper side of the underlayment 20 and are connected in side-by-side relationship by mating tongue 30 and groove 32 construction. It will be appreciated that hardwood is the preferred floor surface; but it is understood that any floor surface can be used within the scope of the present invention.

Each panel 12 is similarly constructed from a rectangular or square core or underlayment 36, lower stringers 38 and upper strips 40, 42 of hardwood having the same tongue and groove interconnection at their sides as the strips of panel 14.

In one preferred embodiment as shown in FIGS. 1–5, the hardwood strips 26, 28, 40, 42 of panels 12 and 14 form the playing surface 44 of the floor and their inboard ends cooperate to provide a staggered interconnection between the interface of adjacent end edges of the panels when in their assembled position. Similarly, the hardwood strips 40, 42 of adjacent panels 12 form the playing surface 44 of the floor and their inboard ends cooperate to provide a staggered interconnection between the interface of adjacent end edges of the panels when in their assembled position.

This interconnection is accomplished by having the inboard ends of alternate hardwood strips longitudinally extend as interlock fingers a predetermined distance beyond the inboard ends of the adjacent strips. These fingers also extend fixed distances beyond the end edges of the underlayments to further define the interdigitated interlock connecting the panels.

Preferably, the fingers extend between 0 and 1 inch and most preferably ⅜" into the inboard edge of the next adjacent panel as described below.

Figure 2:
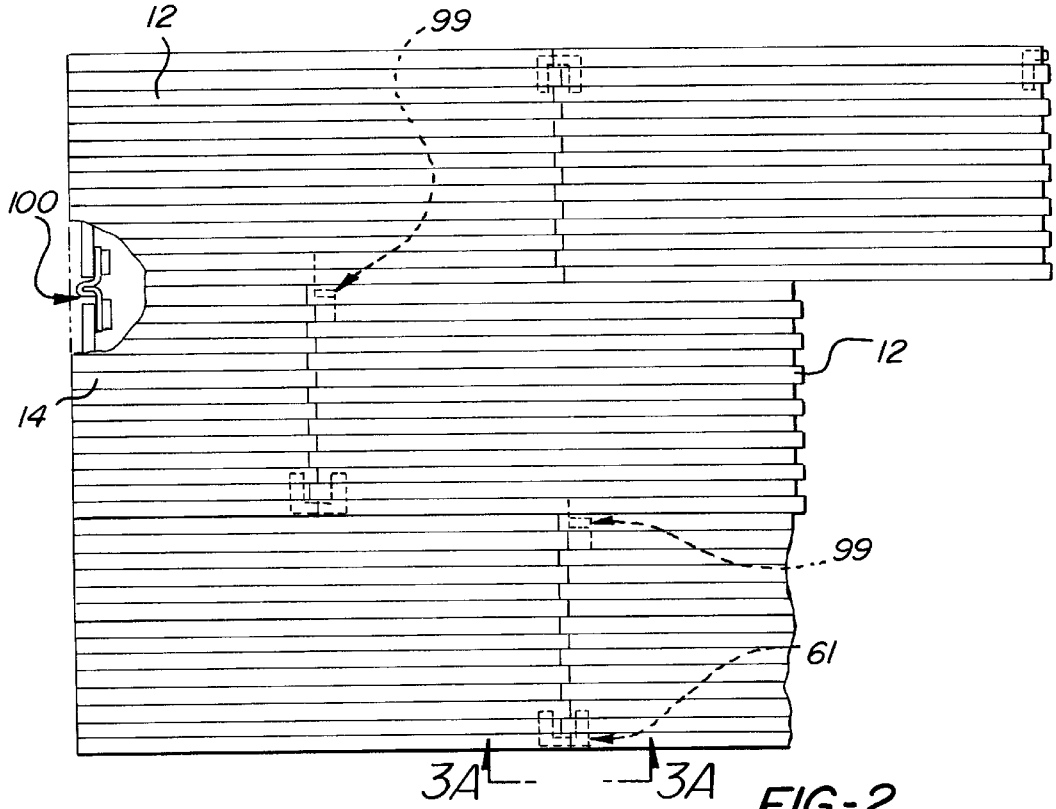
FIG. 2 is a plan view of a portion of an activity floor similar to that of FIG. 1 but with markings removed illustrating the assembly of floor from separate panels.
Figure 3A:
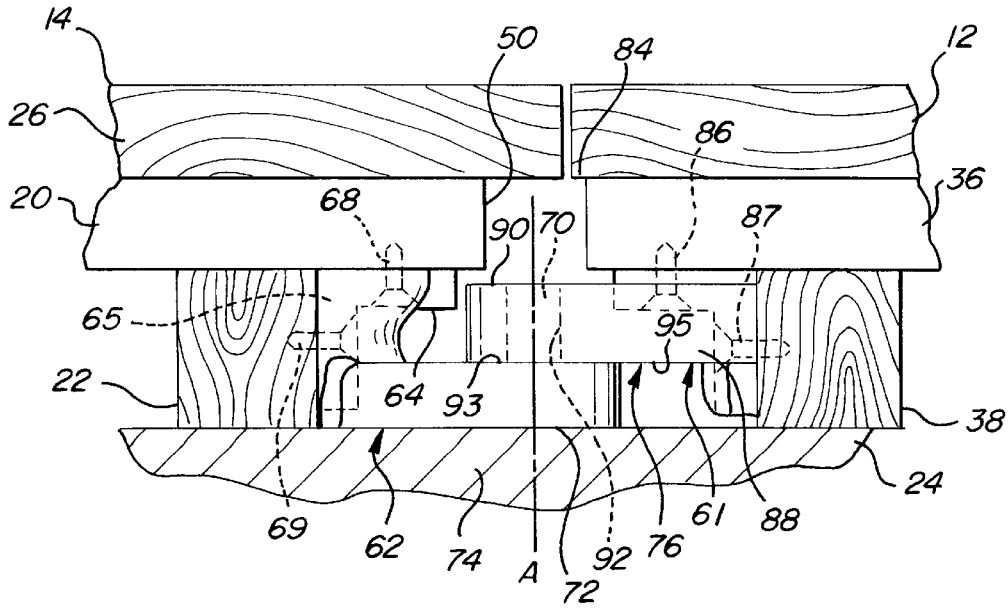
FIG. 3*a* is an end view of a portion of the activity floor of FIG. 2 taken generally along sight lines 3*a*—3*a* thereof.
Figure 3B:
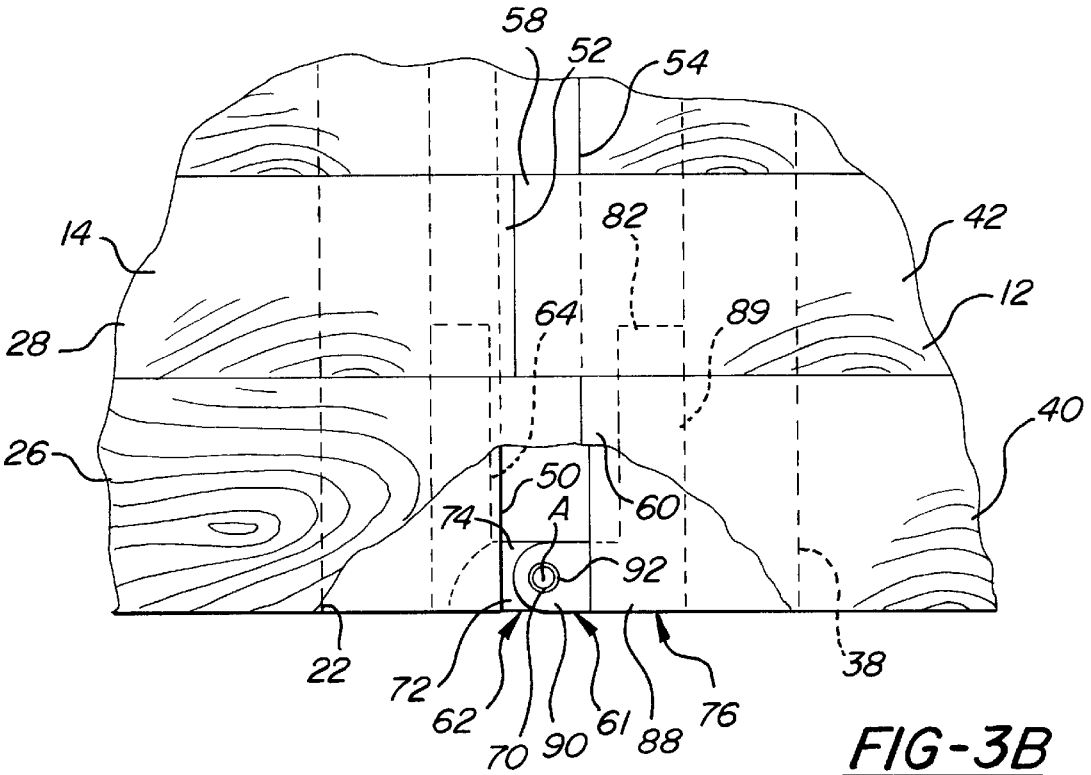
FIG. 3*b* is a further enlarged view of a portion of the activity floor of FIG. 3 with parts broken away.

As shown best in FIGS. 2, 3 and 3*b*, the ends of strips 26 extend beyond the inner side edge 50 of the associated underlayment 20 and the ends 52 of shorter alternate strips 28 to provide long interlock fingers 54. In a corresponding manner, the ends 58 or interlock fingers of hardwood strips 42 of the panels 12 are longer than the ends 60 of alternate and shorter hardwood strips 40. This laterally spaced and alternating finger arrangement of adjacent panels, such as 12 and 14, are longitudinally offset from one another to provide the interlocking finger joint construction, such as illustrated in FIGS. 2, 3 and 3*b*. These finger joints connect the inner sides of adjacent panels (12, 12 or 12, 14) such when the panels are swung into assembly with one another. The panels 12 and 14 are swung into engagement or pivoted through a swing arc (see FIG. 3). In the case of a floor utilizing the interdigitated fingers, the minimum swing arc is a function of the length of the fingers.

To provide for assured and accurate interlocking alignment of the fingers when the panels are swung into an assembled position, pivot bracket sets generally indicated at 61 (FIGS. 4–8) are employed. The brackets of each set pivotally connect the panels to one another with precision so that they can be relatively turned or pivoted from the beginning of the installation on a fixed and predetermined vertical pivot axis A. As can be best seen in FIG. 2, the first row 16 may have the bracket sets 61 listed at the outboard edge of associated panel 12, 14. The remainder of the bracket sets 61 in the rest of the rows 16 are preferably located in the opposite edge of the panels 12, 14 than those of the first row 16.

To this end, each bracket set or assembly 61 comprises a first bracket generally indicated at 62, generally L-shaped in plan view. The first bracket 62 has an upper connector flange 64 and a side connector flange 65. This flange 64 has vertical openings 66 therethrough which receive wood screws 68 (or other suitable fasteners) that are driven into the underlayment 20 to secure bracket 62 at a predetermined position such as in the lower right hand corner of the underlayment 20 of panel 14 (FIGS. 2 and 3). Screws 69 (or other suitable fasteners such as bolts, etc.) pass through horizontal openings in the side connection flange 65 and secure the brackets 62 to the stringers 22.

The first bracket 62 is precisely located in the corner area of the panel 14 so that an upstanding cylindrical pivot 70 carried on the tip 72 of a lower leg 74 of the L-shaped bracket 62 is substantially in vertical alignment with the lower right hand corner of the interlock fingers or end 54 of the bottom strip 26. As illustrated best by FIGS. 3*a* and 4, the upper end of the pivot 70 is free and is located with suitable clearance from underlayment 20 and beneath the interlock finger 54 of the lower strip 26. This provides sufficient room for a second or mating bracket generally indicated at 76 to be operatively mounted thereon.

The mating bracket 76 is also generally L-shaped in plan view and has a leg portion 82 formed with an upper connector flange 84 similar to that of the first bracket. Flange 84 has vertical holes 85 therein for screws 86 (or other suitable fasteners) that fasten the bracket 76 to the lower left side corner of panel 12. Screws 87 (or other suitable fasteners, such as bolts, etc. pass through horizontal openings in the side connector flange 89 and) secure the bracket 76 to stringer 38.

The bracket 76 further has a base leg 88 that has an outer end portion go formed with a vertically extending cylindrical socket 92 therein, which is adapted to receive the vertical cylindrical pivot 70. In one embodiment, the socket 92 is aligned with the lower left hand end corner of panel 12 formed at end 58 of the lower strip 40 of panel 12.

In an alternative arrangement of the bracket set 61, the legs 74 and 88 extend outwardly of their respective panels 12, 14. In this manner, it is easier for the assembler to see the brackets and thereby make the connection of the adjoining brackets. This bracket arrangement is depicted in FIG. 5. Otherwise, all functional aspects of the bracketry remain the same.

The interfacing horizontal surfaces or shoulders 93, 95 (FIG. 3*a*) at the pivot of the brackets provide a vertical stop to assist in the horizontal alignment of the panels with one another. With this bracket construction and with the pivot pin and socket precisely placed, vertical pivot axis A extends between the facing side edges of the underlayments and is located at or adjacent the lower interfacing corners of two panels being connected together.

In either arrangement of the bracket set 61, the pivot 70 is exposed when the first panel 14 of the second row 16 is initially slid into place beneath panel 12 as shown in FIGS. 3 and 3*a*. The first panel 14 of the second row is connected to panel 12 of the first row 16 by the sliding engagement of latching members 100 more particularly shown and described in prior U.S. Pat. No. 4,538,392 referenced above. With the upstanding pivot 70 visible and accessible, the socket 92 of the bracket 76 on panel 12 can be readily fitted thereon to pivotally connect panel 12 to panel 14. Again, the upstanding pivot 70 becomes more readily visible to the installer if the brackets are mounted such that the legs 74 and 88 extend outward of the side edge of the panels 12, 14 (See FIG. 5).

When the panel 12 is initially pivotally connected to the panel 14, it is placed in an angulated position relative thereto, in a 15–45 degree range for example (FIG. 3). This is the swing arc. To interconnect these two panels with interlocking finger joints, panel 12 is manually grasped at its free end and turned counterclockwise in a plane parallel to the support floor. Since the extending interlock fingers of panel 14 are spaced equal distances from one another by alternating strips 28, they closely receive and mesh with the equally spaced interlock fingers 58 of panel 12, as best shown in FIGS. 2, 3 and 3*b*. When in the interlocked position, the fingers of panel 14 have alignment and substantial abutment with the ends of strips of panel 12. Similarly, long interlock fingers 58 of panel 12 have alignment and abutment with the ends of strips 28 of panel 14.

Since the pivot axis "A" provided by the two brackets is selectively located at the lower end of the interface or break line of the two panels, i.e., between the lower abutting fingers 54 and end 60 of the two panels, as shown in FIGS. 3 and 3*b*, and since the interlock fingers are disposed at predetermined locations radially and outwardly of the pivot axis A, the panels can be swung into their assembled position with precision fit between the interlocking fingers and with minimized frictional contact and wear between any of the fingers.

In the assembled position, releasable connectors 97 are employed between the section ends of adjacent rows 16. The connector 97 secures the free ends of the adjacent rows 16. The releasable connectors 97 correspond to the releasable connectors of commonly assigned prior U.S. Pat. No. 4,538,392. Of course, any connector that can serve the free ends of adjacent rows 16 may be used within the context of the present invention.

In the assembled position, a slide latch device 99, which corresponds to the slide latch device of commonly assigned prior U.S. Pat. No. 4,538,392 referenced above, secures the free ends of panels not located at the outboard edge of the floor assembly such as 12 and 14 together when moved to their assembled position. Of course, any connection may be used to secure the free ends of the panel with the content of the present invention. Subsequent to the movement of the panel 12 into position with other panels can be assembled in a similar manner using this new and improved pivot joint construction.

The other hardware used in this floor may be the same as that in the prior floor of the above referenced patent, and the panels finally locked together.

Removal is preferably the reverse of procedure as described above and the panels can be swung in a plane generally parallel to the support floor without particular attention being paid to the interlocking fingers and the panels can be disassembled without damage to the finger interlocks.

In the embodiment shown in FIGS. 6–9, the bracket set 161, corresponding to bracket set 61 of FIGS. 1–5, is used with square end panels. Like numerals, offset by 100 will be used to denote similar structure among the various embodiments. It is to be understood that unless specifically stated otherwise, the various structure have the same structure and perform the same function among the various embodiments. The square end panels do not utilize an interlock finger arrangement of the hardwood strips. Rather, each of the hardwood strip 126, 142 are even at the edge of the panel 114, 112 and provide a straight or "square" edge.

The bracket set 161 is shown such that the pivot 170 and cylindrical socket 192 extends outwardly of the side edge of the panel 114, 112 (as in the FIG. 5 embodiment). In this manner, connection of the pivot 170 and socket 192 is facilitated because the pivot 170 and socket 192 and more easily seen by the installer. Panel 114 and 112 may be arranged in conventional style or in parquet style each of which styles have straight side and top and bottom edges. The bracket set 161 and a latch device 110, such as shown in FIG. 3, hold the panels 114, 112 in assembled position to form an attractive flat performance surface.

The bracket set 161 performs an important function in floors having square ends or square edges. In these types of floors, when the pivot 170 is received in the socket 192, the panels 114, 112 are laterally locked with respect to each other. That is, while the panels 114, 112 may respectively pivot with respect to another, there can be no lateral movement of the panel 114 with respect to the other panel 112. This feature is important in a square end or square edge type floor, because there are no fingers (as described with the embodiment above) to prevent lateral movement of the panels 112, 114. Rather, this function is provided only by the assembled bracket assembly 161. It will be appreciated that the bracket assembly 161 provides the same function in a floor of the type described above having interdigitated fingers, the fingers also aid in preventing lateral movement of the adjacent panels 12, 14.

In floors of the type having square edges, the swing arc can be dramatically reduced because there is no need to rotate the panels 112, 114 for interdigitated fingers. Accordingly, such a floor has great flexibility for use in confined spaces. Further, using bracketing as described above where the pivot connection is spaced laterally from the panels 112, 114, allows the swing arc to be reduced even more. In such an arrangement, the assembler can place the adjacent panel virtually in position while making the pivot connection, because the pivot connection can still be seen adjacent the panels.

The flat shoulder interfaces 193 and 195 of the bracket set 161 provides a vertical stop to improve alignment of the upper surfaces of panels 112 and 114 with one another.

In floors of the type having square edges, it may also be desirable to include a support generally indicated at 200 under the underlayment 120, 136 of adjoining panels. This support may take any form within the context of the present invention. One example of such a support is shown in FIGS. 6–9. As shown, the support 200 comprises a lap joint arrangement. That is, a substantially flat length of material 210 (such as plastic, wood or any other suitable material) is mounted (via fasteners such as screws) directly to the bottom surface of the underlayment 136 of one panel 112 at its end. A second, generally L-shaped length of material 212 is mounted directly to the bottom surface of the underlayment 120 of the next adjacent panel 114 at its edge. The L-shape of the length of material 212 forms a pocket 214 for receiving the flat length of material 210 to be inserted (See FIG. 8). The flat length of material 210 extends beneath the underlayment 120 of the next adjacent panel 114 and into the socket 214. In this manner, the seam between adjacent panels 114, 112 is supported from the bottom to prevent undue flexing of the floor at the joint.

The length of the supports approximates the length of the associated floor panel 112, 114. Of course, the supports may be of any length. Similarly, shorter length may be used and spaced along the associated edges of the respective panels.

Figure 8:
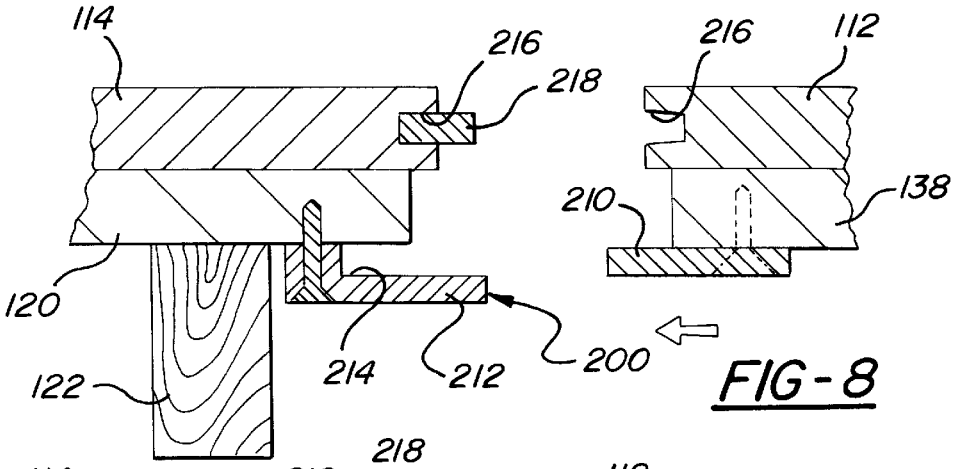
FIG. 8 is a sectional view of the floor of FIG. 6 showing the floor panels in a disassembled state with parts broken away.
Figure 9:
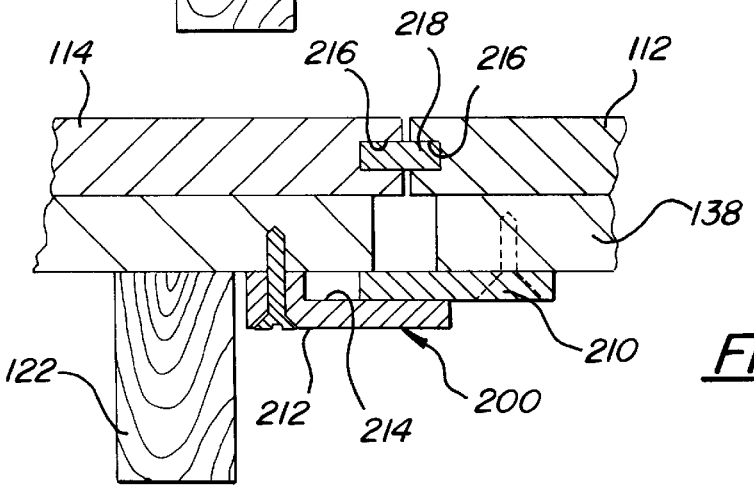
FIG. 9 is a sectional view of the floor of FIG. 6 with the floor panels in the assembled state with parts broken away.

It may also be desirable to further support the end-to-end seam between adjacent panels 114, 112. This may be accomplished by providing a groove 216 by the edge of each panel 112, 114. A slip tongue 218 may then be secured (in any well known manner) in one of the grooves 216. When the panels 112, 114 are disassembled, the slip tongue 218 extends outwardly of the edge of the panel 114 (FIG. 8).

The slip tongue 218 is adapted to seat with the groove 216 on the edge of the adjacent panel 112. When the panels 112, 114 are assembled (FIG. 9), the slip tongue 218 seats within the groove 216 of the adjacent panel 112. In this manner, the seam between adjacent panels 114, 112 is strengthened and flexing of the floor assembly at the seam is reduced.

While the preferred embodiment of the invention has been shown and described, other embodiments will now become apparent to those skilled in the art. The invention, has, thus, been described in an illustrative manner, and it is to be understood that the terminology which has been used is intended to be in the nature of words of description rather than of limitation.

Obviously, many modifications and variations of the present invention are possible in light of the above techniques. It is, therefore, to be understood that within the scope of the appended claims, the invention may be practiced otherwise than as specifically described.

What is claimed is:

1. A portable multi-panel floor assembly capable of being disassembled into a plurality of rectilinear floor panels and reassembled into a unitized continuous performance floor structure; the assembly comprising:

first and second floor panels having respective end edges abutting one another in edge-to-edge alignment in an assembled position; and a pivot bracket set comprising a first bracket member secured to said first panel and a pivot pin fixed to the first bracket member, the pivot pin defining a fixed pivot axis;

the pivot bracket set additionally comprising a second bracket member secured to said second panel and an opening disposed in the second bracket member, the opening axially and removably receiving the pivot pin to connect the first and second panels for pivotal motion relative to one another to allow the panels to be disassembled by pivoting the panels away from each other on said fixed pivot axis to an initial position then disconnecting the panels by axially separating the pin and the opening and to allow the panels to be assembled by moving the panels to the initial position then pivoting the panels to the assembled position.

2. The multi-panel floor assembly of claim 1 wherein said pivot of said first bracket member is defined by an upwardly extending pivot pin.

3. The multi-panel floor assembly of claim 2 wherein said opening of said second bracket member is defined by a socket, said socket adapted to receive said pivot pin to define said pivot axis.

4. The multi-panel floor assembly of claim 3 wherein said first and said second bracket members have laterally extending shoulders which interface with one another to form a stop which operatively aligns of said panels with one another.

5. The multi-panel floor assembly of claim 4 wherein said first and said second bracket members extend outwardly of the side edges of panels, whereby said pivot axis is located outwardly of the side edges of adjacent panels.

6. A portable multi-panel floor assembly capable of being disassembled into a plurality of rectilinear floor panels and reassembled into a unitized continuous performance floor structure; the assembly comprising:

first and second floor panels having respective end edges abutting one another in edge-to-edge alignment in an assembled position; and a pivot bracket set comprising a first bracket member secured to the first panel and a pivot pin fixed to the first bracket member, the pivot pin defining a fixed pivot axis;

the pivot bracket set additionally comprising a second bracket member secured to the second panel and an opening disposed in the second bracket member, the opening axially and removably receiving the pivot pin;

the pivot of the first bracket member being defined by an upwardly extending pivot pin;

the opening of the second bracket member being defined by a socket, the socket being adapted to receive the pivot pin to define the pivot axis;

the first and second bracket members having laterally extending shoulders that interface with one another to form a stop that operatively aligns the panels with one another; and each of said floor panels including a plurality of spaced apart stringers, an underlayment secured to said stringers and an upper floor surface secured to said underlayment.

7. The multi-panel floor assembly of claim 6 wherein said first and said second bracket members are each secured to at least one of said sleepers and said underlayment of respective adjacent floor panels.

8. The multi-panel floor assembly of claim 6, wherein said ends of said floor surface of each of said panels have extending and laterally spaced fingers which interdigitate with one another when said panels are in said assembled position.

9. The multi-panel floor assembly of claim 6, wherein said ends of said floor surface of each of said panels are straight and interface one another when said panels are in said assembled position.

10. A portable multi-panel floor assembly capable of being disassembled into a plurality of rectilinear floor panels and reassembled into a unitized performance floor, the assembly comprising:

first and second numbers of floor panels, each being formed with an underlayment having upper and lower surfaces, each of said panels having a plurality of finishing strips of wood secured in a side-by-side manner to said upper surface of said underlayment so that they extend in a predetermined direction, a first number of said strips extending a predetermined distance across said underlayment, a second number of strips interposed between said first strips and extending beyond the ends of said first strips and cooperating therewith to form spaced finger joints for each of said panels;

a first hinge secured to said underlayment of each panel of said first number of panels and having an upwardly extending pivot disposed at one corner of each panel of said first number of panels, a second hinge secured to said underlayment of each panel of said second number of panels and having a socket receiving said pivot disposed at one corner of each of said second number of panels, said pivots removably fit into said sockets and pivotally connecting said first and second panels to one another, the hinges configured to allow the first and second panels to be disassembled by swinging pivotally connected pairs of the panels away from each other on respective fixed pivot axes to an initial interconnected position from respective installed positions in which said finger joints of said strips of said first and second panels interlock with each other with minimized frictional contact therebetween and said strips of said panels cooperate to form a continuous finish surface of said performance floor, then disconnecting the panels by axially separating the pin from the opening the hinges additionally configured to allow the panels to be assembled by moving the panels to their respective initial positions then pivoting the panels to their respective installed positions.

11. A portable multi-panel floor assembly capable of being disassembled into a plurality of rectilinear floor panels and reassembled into a unitized structure; the assembly comprising:

a plurality of panels having end edges adapted to abut one another in longitudinally adjacent edge-to-edge alignment;

a pivot bracket set releasably and pivotally connecting said longitudinally adjacent ones of said floor panels to one another, each said bracket set comprising a first bracket member secured to one of said longitudinally adjacent panels having a coupling post defining a fixed, generally vertical pivot axis adjacent a corner of said one panel, and each bracket set comprising a second bracket member secured to another of the panels that is disposed longitudinally adjacent the one panel, the second bracket member having a fixed recess adjacent a corner of said other panel, the recess operatively receiving said post of said one panel and thereby connecting said other panel pivotally to said one panel for rotation about said fixed axis between an initial position in which the panels are swung apart from one another and an assembled position in which said panels abut one another in edge-to-edge alignment and cooperate to form a continuous performance floor.

12. A method of constructing a portable, multi-section activity floor system, comprising:

preparing a plurality of individual floor panels having opposite side edges and opposite end edges and corners adapted to be assembled in adjacent edge-to-edge relationship to provide a continuous portable, activity surface;

mounting a first bracket member to one of said panels to be assembled adjacent a corner thereof having a base and a generally vertical mounting post extending from said base to a free end in laterally spaced relation to said one panel;

mounting a second complimentary bracket member to another of said panels adjacent a corner thereof having a base and a recess sized to accommodate said mounting post therein;

positioning one of the panels to be assembled on a generally horizontal planar support surface;

positioning the other of the panels to be assembled on the support surface and extending the mounting post of the first bracket into the recess of the second bracket to establish a pivot connection between the two panels to be joined; and relatively rotating the panels about the axis of the mounting post to bring adjacent end edges of the panels into abutting relationship with one another.

13. The method of claim 12 wherein the mounting position extends vertically upwardly from the base and the panels are connected by lowering the bracket of one of the panels into engagement with the bracket of the other panel such that the mounting post is caused to extend into and be captured within the recess.

* * * * *